United States Patent [19]

Brackett et al.

[11] 4,375,772

[45] Mar. 8, 1983

[54] SCREW ANCHOR SCREW REMOVAL DEVICE

[75] Inventors: Neil C. Brackett, Hanahan; William W. Kester, Charleston, both of S.C.

[73] Assignee: Margaret M. Milhouse, Charleston Heights, S.C.

[21] Appl. No.: 231,764

[22] Filed: Feb. 5, 1981

[51] Int. Cl.[3] ..... B25B 23/00

[52] U.S. Cl. ..... 81/462; 81/180 R

[58] Field of Search ..... 81/180 R, 462, 58.1

[56] References Cited

U.S. PATENT DOCUMENTS

| | | | |
|---|---|---|---|
| 1,417,725 | 5/1922 | Fullenwider | 81/180 R X |
| 2,610,659 | 9/1952 | Shaker | 81/462 |
| 2,632,486 | 3/1953 | Fetsko | 81/462 |
| 4,015,490 | 4/1977 | Burrous | 81/180 R |

FOREIGN PATENT DOCUMENTS

| | | | |
|---|---|---|---|
| 14255 | 3/1926 | Netherlands | 81/462 |

*Primary Examiner*—James G. Smith

*Attorney, Agent, or Firm*—Larry H. Kline

[57] ABSTRACT

A device is disclosed for removing a plurality of screws from a surface utilizing a threaded screw opening in the surface comprising a structure, a screw anchor assembly, a screw removal assembly, drive means, and pressure handle assembly.

32 Claims, 10 Drawing Figures

SCREW ANCHOR SCREW REMOVAL DEVICE

This invention relates to a device for removing screws and more particularly to a device which can be utilized to remove screws which are in a particular condition or are difficult to remove.

In many instances, screws may be corroded, stuck, or have screw heads which are slightly damaged. In removing panels, for example an aircraft panel, a plurality of screws may secure the panel. If some of the plurality of screws are corroded, stuck, or have screw heads that are damaged, a method needs to be utilized to remove the screws without damaging the panel. The present invention is capable of removing these difficult to remove screws without damaging the panel, the plurality of screws, or the threaded hole in which the screw is secured.

An object of the present invention is to provide a device for removing a plurality of screws that are corroded, stuck, or have screw heads that are damaged without damaging the panel that the screws secure.

Another object of the present invention is to provide a device for removing a plurality of screws in a panel by utilizing one of the threaded screw holes in the panel to secure the device into.

A further object of the present invention is to provide a device for removing a plurality of screws in a panel which is simple, compact, light, and safe.

Still another object of the present invention is to provide a device for removing a plurality of screws in a panel which can utilize one threaded screw hole to anchor the device into and which has a sliding block assembly which can be positioned over a plurality of screws from the initial anchored position.

A further object of the present invention is to provide a device with a screw anchor assembly which is adjustable and pivots in order to utilize the device for removing a plurality of screws in a flat or curved surface.

Another object of the present invention is to provide a pressure handle assembly as part of a device for removing a plurality of screws in a panel which may be utilized for better gripping, applying leverage, and multiplying the force on the screw being removed.

Still another object of the present invention is to provide a device for removing a plurality of screws in a panel which can be stored compactly and is easily removed from the storage position to a position for utilization.

A further object of the present invention is to provide a device for removing a plurality of screws in a panel which may utilize different size and types of screw tips for removal of screws with different types of screw heads.

Another object of the present invention is to provide a device for removing a plurality of screws in a panel which can be anchored into one of the threaded screw holes in the panel and can be positioned so that the removal screw tip is perpendicular to the screw surface of the screw being removed.

Still another object of the present invention is to provide a device for removing a plurality of screws in a panel which may utilize a variety of driving handle mechanisms, such as a "T" handle or ratchet.

A further object of the present invention is to provide a device for removing a plurality of screws in a panel which is relatively quick and can apply sufficient pressure to remove the desired screw without damaging the panel or the threaded screw being removed, or the threaded screw hole.

Another object of the present invention is to provide a device for removing a plurality of screws in a panel which contains storage means sufficiently large to utilize for storage of a variety of screws and screw tips to be utilized with the device.

These and other objects and features of the invention will be apparent from the following description and appended claims.

Briefly, the invention is a device for removing a plurality of screws from a surface utilizing a threaded screw opening in the surface. The device comprises a structure, a screw anchor assembly, a screw removal assembly, and driving means. The screw anchor assembly is adjustably and pivotably mounted on the structure and is operative to be secured in the threaded screw opening. The screw removal assembly is adjustably mounted on the structure and operative to be pressed into the top of one of the plurality of screws. The driving means is secured to the screw removal assembly. The driving means is operative to move the screw removal assembly in order to move the one of the plurality of screws from the surface. The screw removal assembly can be positioned over any of the plurality of screws remaining for removal purposes by utilizing the threaded screw opening or another threaded screw opening in the surface which might be created by removal of any one of the plurality of screws. A pressure handle assembly is pivotably secured to the structure. The pressure handle assembly is operative to aid in gripping the device, applying leverage to the screw removal assembly, and multiplying the force exerted in order to remove one of the plurality of screws. The screw anchor assembly comprises an anchoring screw operative to be secured into the threaded screw opening. An anchoring screw turning means is rigidly securable to the anchoring screw. The anchoring screw turning means is operative to move the anchoring screw in order for the anchoring screw to be secured into or removed from the threaded screw opening. A height adjustment means is operative to vary the height of the screw anchor assembly with respect to the structure. The height adjustment means varys the distance of the anchoring screw from the structure. The anchoring screw retaining member is operable to hold the anchoring screw and is securable to the anchoring screw turning means. The anchoring screw is held rigidly in the screw anchor assembly when the anchoring screw is placed into the anchoring screw retaining member and the anchoring screw retaining member is rigidly secured to the anchoring screw turning means. The anchoring screw retaining member has a sloped lower section. The anchoring screw may have a screw head of varying dimensions and still properly be secured in the anchoring screw retaining member. The anchoring screw turning means has a flat bottom which presses against the top of the anchoring screw within the anchoring screw retaining member in order to rigidly secure the anchoring screw. The anchoring screw turning means extends above, through and below the height adjustment means.

The screw anchor assembly further comprises a structural member pivotably mounted on the structure. The structural member comprises an opening through which a portion of the height adjustment means extends. Securing means is secured to the structural member and is operative to mount the structural member pivotably on the structure. The opening in the structural member is a threaded opening and the portion of the height adjustment means extending therethrough is a threaded portion.

The screw removal assembly comprises a structural body, a drive element, a tip holder, and a screwdriver tip securable in the tip holder. The structural body is adjustably mounted on the structure. The drive element extends through the structural body. The tip holder is secured to the driven end of the drive element. The screwdriver tip is securable within the tip holder and is operative to be pressed into the top of one of the plurality of screws. The screw removal assembly further comprises a pressure bearing, a retaining collar, and retaining means securing the retaining collar. The pressure bearing is secured into the structural body with the drive element extending therethrough. The retaining collar is secured to the driven end of the drive element and is operative to press against the pressure bearing and to secure the drive element within the structural body. The tip holder is operative to hold one of the plurality of screwdriver tips of varying dimensions.

The structure comprises a plurality of rails. The structural body comprises a plurality of body extensions extending therefrom. The plurality of body extensions extend over the plurality of rails thereby slidably mounting the screw removal assembly on the structure. The driving means may be a "T" handle secured to the screw removal assembly. The driving means may be a ratchet handle secured to the screw removal assembly. The pressure handle assembly comprises storage means. The pressure handle assembly comprises a pressure handle, a pivot section, a stop, and a pressure surface located between the pressure handle and the pivot section. The pivot section is pivotably secured to the structure. The stop is secured to the structure. The pressure surface is operative to press against the stop when pressure is applied by the pressure handle. The pressure handle assembly further comprises a storage stop section which is operative to press against a stop to aid in securing the pressure handle assembly when the device is stored.

The screw removal assembly has an indentation within which the tip of the anchoring screw is secured when the device is stored. The tip of the anchoring screw is protected when the device is stored. The pressure handle assembly is pivotably secured to the structure and is operative, when stored, to be secured within the structure. The pressure handle assembly presses against the screw removal assembly with the tip of the anchoring screw tightened into the indentation, thereby securing the pressure handle assembly, the screw removal assembly, and the screw anchor assembly tightly together. The screw anchor assembly is designed so that the height may be adjusted. The screw anchor assembly may pivot on the structure. The screw removal assembly is slidably mounted on the structure.

The invention will be more fully understood from the following detailed description and appended claims when taken with the drawings in which:

Figure 1:
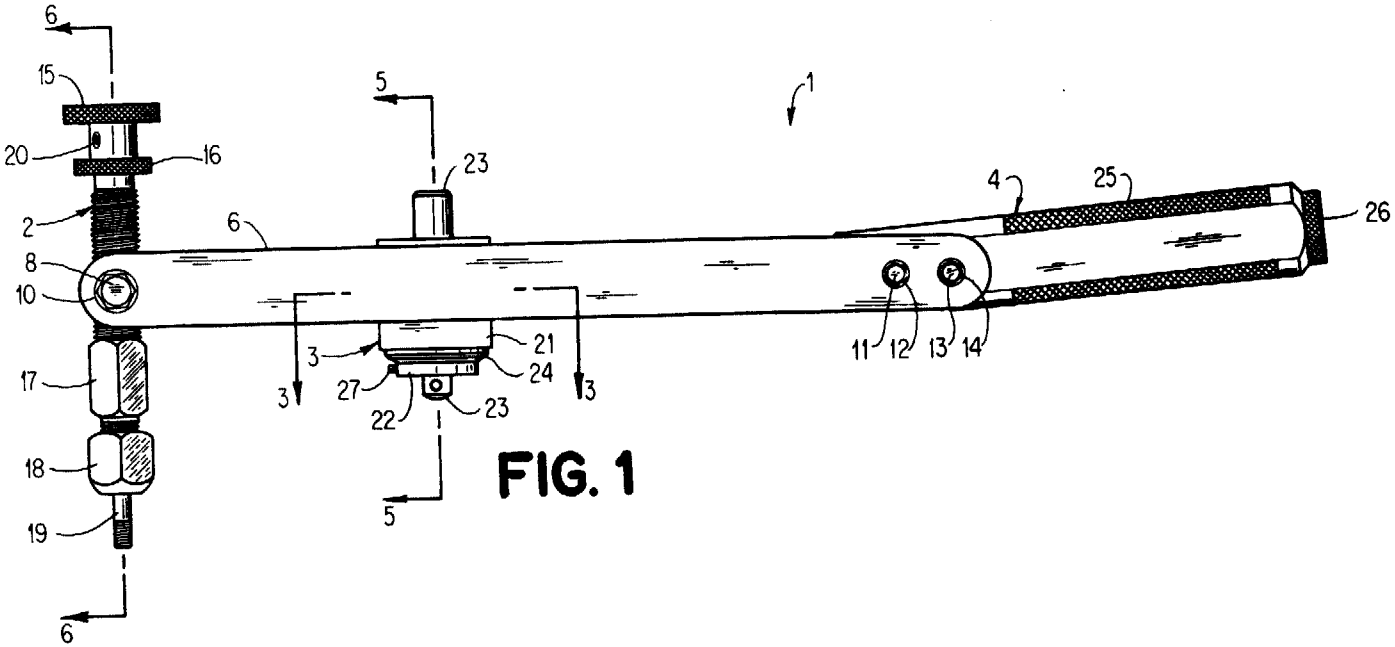
FIG. 1 is a side elevational view of device 1 in a position to be utilized.
Figure 2:
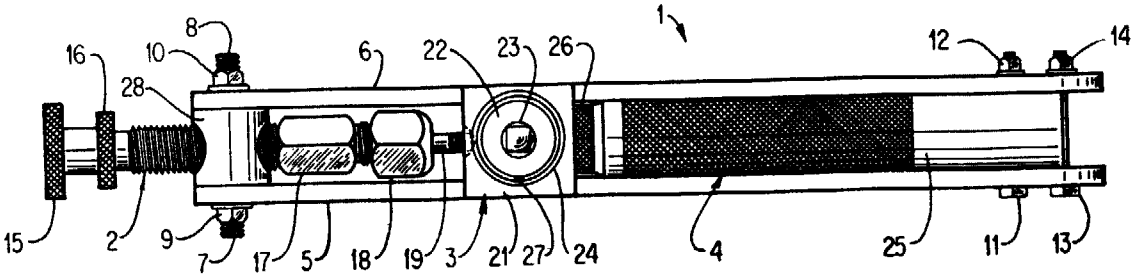
FIG. 2 is a bottom elevational view of device 1 in a stored position.
Figure 3:
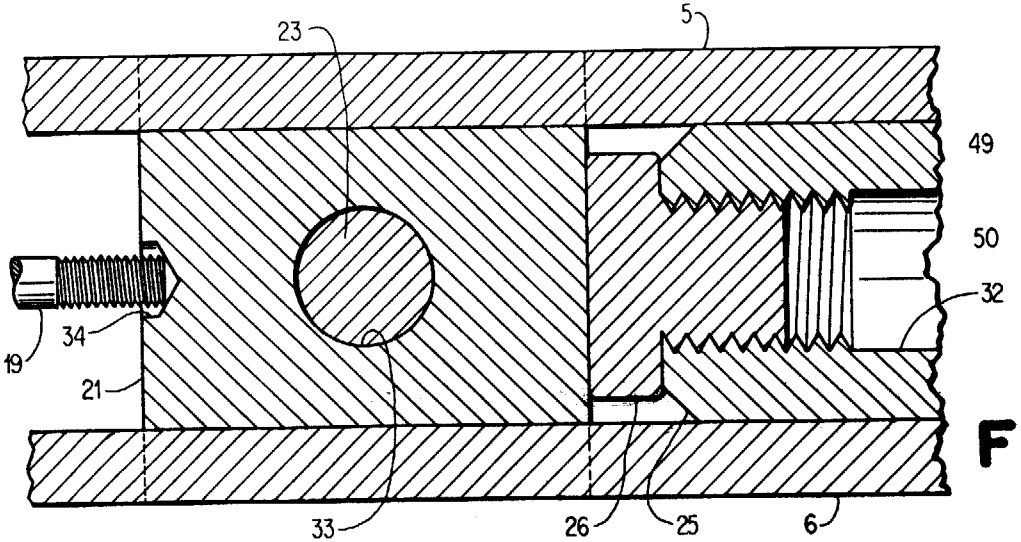

FIG. 3 is a cross-sectional view of sliding block assembly 3 taken at section 3—3 of FIG. 1, but with the device 1 in a stored position as shown in FIG. 2.

Figure 4:
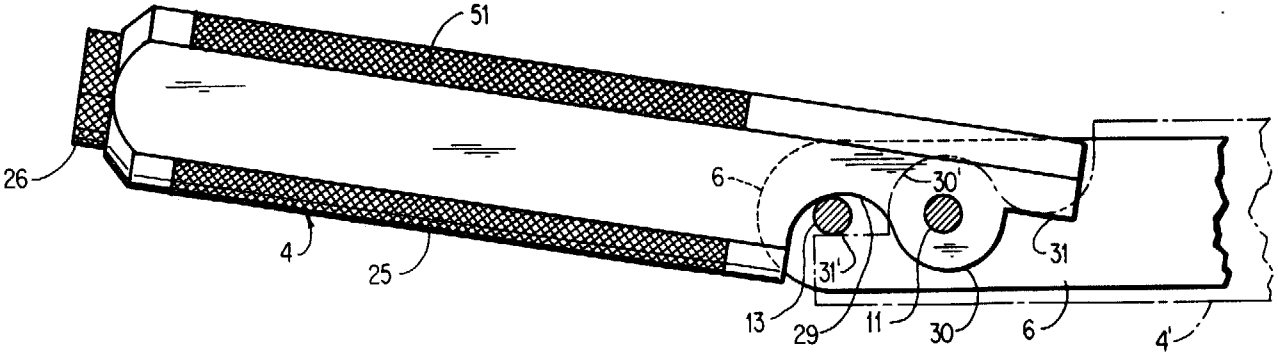

FIG. 4 is a partial sectional view of pressure handle assembly 4 shown in a position for utilization in solid lines and shown in a position of storage in phantom lines.

Figure 5:
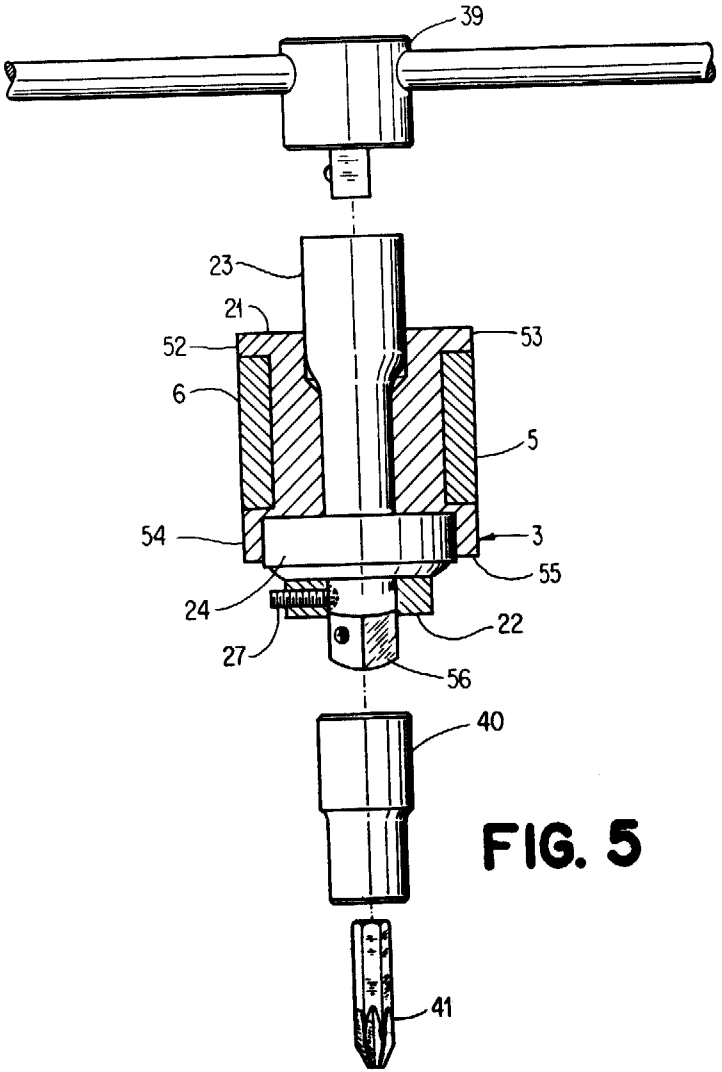

FIG. 5 is a longitudinal sectional view of sliding block assembly 3 with tool attachment 39 and screwdriver tip holder 40 and screwdriver tip 41 exploded therefrom.

Figure 6:
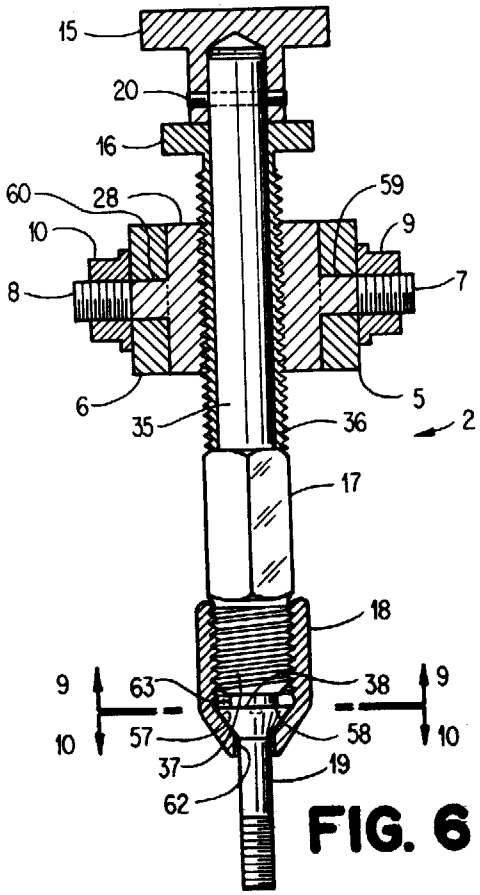

FIG. 6 is a cross-sectional view through the adjustable pivoting screw anchor assembly 2.

Figure 7:
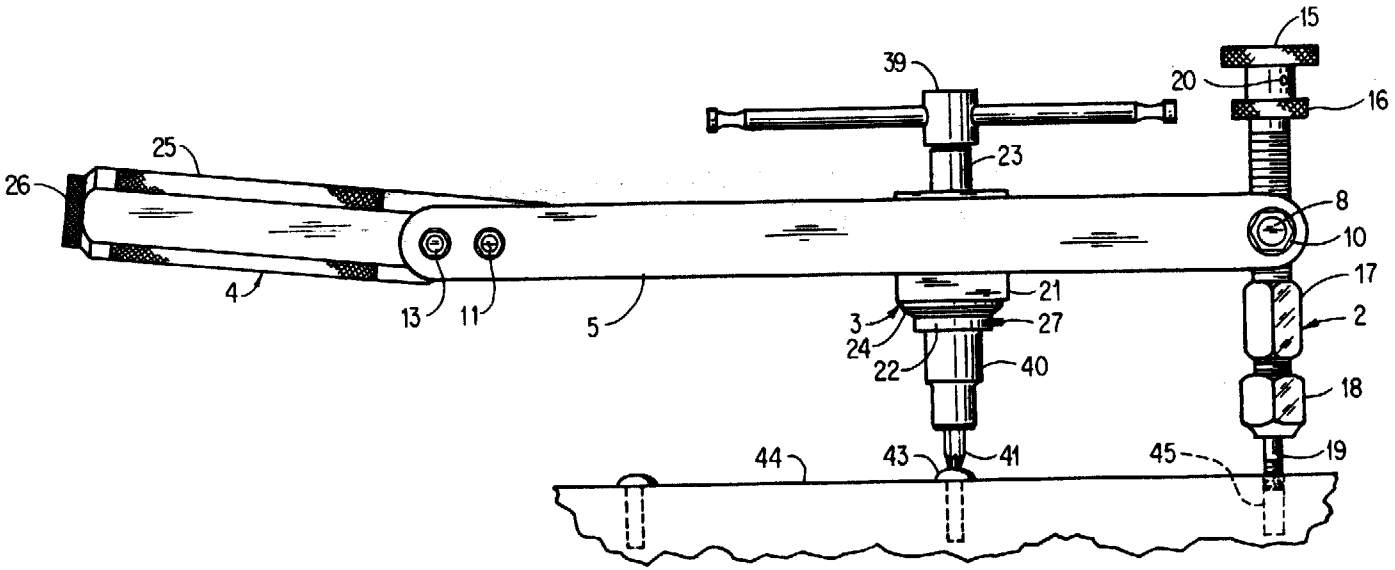

FIG. 7 is a side elevational view of device 1 being utilized on a flat surface 44.

Figure 8:
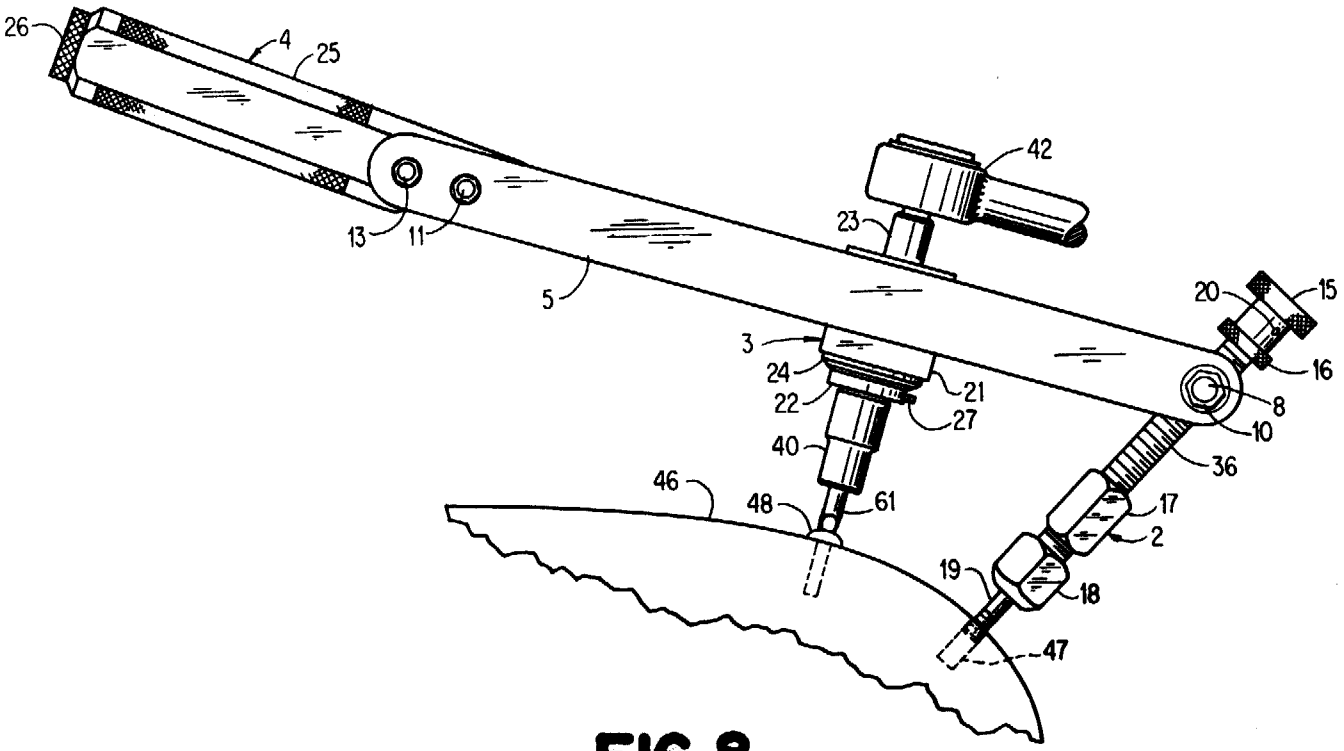

FIG. 8 is a side elevational view of device 1 being utilized on a curved surface 46.

Figure 9:
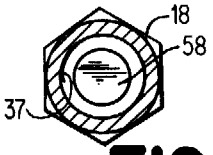

FIG. 9 is a sectional view taken at section 9—9 of FIG. 6.

Figure 10:
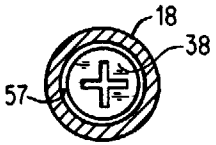

FIG. 10 is a sectional view taken at section 10—10 of FIG. 6.

Referring now to the drawings, FIG. 1 is a side elevational view of device 1 in a position to be utilized. Device 1 has an adjustable pivoting screw anchor assembly 2, a sliding block assembly 3, and a pressure handle assembly 4.

FIG. 2 is a bottom elevational view of device 1 in a stored position. The adjustable pivoting screw anchor assembly 2, the sliding block 3, and the pressure handle assembly 4 are mounted on a rail assembly consisting of left side rail 5 and right side rail 6. The adjustable pivoting screw anchor assembly 2 is held between left side rail 5 and right side rail 6. Left threaded portion 7 extends through left side rail 5 and is secured by nut 9. The right threaded portion 8 extends through right side rail 6 and is secured by nut 10. The adjustable pivoting screw anchor assembly 2 is secured in a manner that it may pivot completely around the axis on which it is secured to the point where screw anchor knob 15 hits the rail assembly, including left side rail 5 and right side rail 6. If desired, the screw anchor knob 15 could be made small enough so that the adjustable pivoting screw anchor assembly 2 could pivot 360° around its axis where it is secured. The adjustable pivoting screw anchor assembly 2 will be explained in more detail in the discussion of FIG. 6.

The sliding block assembly 3 slides freely on the rail assembly which includes left side rail 5 and right side rail 6. The sliding block assembly 3 will be discussed in more detail in the discussion of FIG. 5.

The pressure handle assembly 4 is secured between left side rail 5 and right side rail 6 and is secured by nut 12. Stop bolt 13 extends through left side rail 5 and extends through the pivot section 30 of pressure handle 25 and then through right side rail 6 and is secured by nut 14. The pressure handle assembly 4 will be discussed in more detail in the discussion in FIG. 4.

Device 1 may be stored compactly and conveniently as shown in FIG. 2. In storing device 1, the adjustable pivoting screw anchor assembly 2 may be pivoted about its axis until the anchoring screw 19 is directly between left side rail 5 and right side rail 6. The sliding block assembly 3 can then be slid on the left side rail 5 and right side rail 6 until the anchoring screw 19 is placed within the locking indentation 34 in sliding block assembly 3. The pressure handle assembly 4 is pivoted on pivot bolt 11 until the pressure handle assembly 4 is placed between left side rail 5 and right side rail 6. The sliding block assembly 3 is then pressed against the top of plug 26. The adjustable pivoting screw anchor assembly 2 can then be tightened down to secure the various assemblies, adjustable pivoting screw anchor assembly 2, sliding block assembly 3, and pressure handle assembly 4, tightly together. The adjustable pivoting screw anchor assembly 2 may be tightened or loosened by utilization of the screw anchor height adjustment knob 16.

FIG. 3 is a cross-sectional view of sliding block assembly 3 taken at section 3—3 of FIG. 1 but with the device 1 in a stored position as shown in FIG. 2. In the stored position, anchoring screw 19 fits within locking indentation 34 of sliding block 21. Sliding block 21 has an opening 33 through which the drive element 23 extends. The pressure handle 25 presses against the sliding block 21 with plug 26 pressing against sliding block 21. Plug 26 is a pressure handle storage compartment closure plug 26. Pressure handle storage compartment closure plug 26 has threads 49 which screw onto threads 50 within the end of pressure handle 25. Pressure handle 25 has a pressure handle storage compartment 32 within it. Various spare or alternate parts may be stored within pressure handle storage compartment 32. Pressure handle storage compartment 32 may be of any dimension desired within the pressure handle 25.

FIG. 4 is a partial sectional view of pressure handle assembly 4 shown in a position for utilization in solid lines and shown in a position for storage in phantom lines. Pressure handle assembly 4 is mounted onto left side rail 5 (not shown) and right side rail 6. Pressure handle 25 pivots on pivot bolt 11. Pivot bolt 11 extends through the pivot section 30 of pressure handle 25. Pressure handle 25 has pressure surface 26 which may be rounded to press onto stop bolt 13 in order to apply pressure with pressure handle 25. When the pressure handle assembly 4 is stored, the stop section 31 of pressure handle 25 may press against stop bolt 13. When the device 1 is placed in a stored position as in FIG. 2, the stop section 31 of pressure handle 25 may press against stop bolt 31 in order to prevent the pressure handle 25 from pivoting completely around the axis of pivot bolt 11.

The pressure handle assembly 4 is shown also in the position that it would be in storage in phantom lines. The pressure handle assembly 4 in storage is designated as 4'. The pivot section of pressure handle 25 is designated as 30'. The stop section 31 of the pressure handle 25 is designated as 31'. As can be noted, when in storage, the stop section 31' of pressure handle 25 is pressed against stop bolt 13 to prevent the pressure handle assembly 4 from pivoting any further than desired. The pressure handle 25 can be a smooth surface or a knurled surface or any gripping surface such as grip aiding surface 51.

FIG. 5 is a longitudinal sectional view of sliding block assembly 3 with tool attachment 39 and screwdriver holder 40 and screwdriver tip 41 for a screw with a multiple edge screw head exploded therefrom. Sliding block assembly 3 slides on rails 5 and 6. Sliding block 21 has portions which serve as a guide and to hold sliding block 21 onto rails 5 and 6. Left extensions 53 and 55 guide and hold sliding block 21 onto left side rail 5. Right extensions 52 and 54 guide and hold sliding block 21 onto right side rail 6. Connected into sliding block 21 is pressure bearing 24. Pressure bearing 24 and sliding block 21 have an opening through which drive element 23 extends. Retaining collar 22 secures the drive element 23 within sliding block 21. Retaining screw 27 secures the retaining collar 22 onto the drive element 23. The drive element 23 has at its end a drive connector 56 which secures to screwdriver tip holder 40. Screwdriver tip 41 connects within screwdriver tip holder 40. A tool attachment 39 connects within drive element 23 for use in the screw removal process.

FIG. 6 is a cross-sectional view through the adjustable pivoting screw anchor assembly 2. Adjustable pivoting screw anchor assembly 2 has a screw anchor knob 15 which effectively turns the anchoring screw 19. Screw anchor knob 15 is held onto shaft 35 by retaining pin 20. Screw anchor knob 15 is connected to shaft 35 which extends through screw anchor height adjustment knob 16 and threaded hollow shaft 36. Shaft 35 is rigidly secured to shaft base 17. Extending from shaft base 17 is threaded end portion 37. Threaded anchor screw retaining member 18, after anchoring screw 19 is placed within it, screws onto the threaded end portion 37 of shaft base 17. The bottom of threaded anchor screw retaining member 18 has sloped opening 57 which enables the threaded anchor screw retaining member 18 to function with various size screws and screw heads. The top 38 of anchoring screw 19 presses against flat bottom portion 58 of threaded end portion 37 of shaft base 17.

Screw anchor height adjustment knob 16 is connected to threaded hollow shaft 36. By turning screw anchor height adjustment knob 16, the threaded hollow shaft 36 can move up and down within the threaded pivot block 28. Pivot block 28 as a threaded opening through which the threaded hollow shaft 36 extends. Pivot block 28 has a left extension 59 which extends through an opening in left side rail 5 and a threaded end portion of extension 59 to which nut 9 is screwed onto to secure pivot block 28 between rails 5 and 6. Pivot block 28 has an extension 60 which extends through an opening in right side rail 6 and a threaded end portion of extension 60 to which nut 10 is screwed onto to secure pivot block 28 between rails 5 and 6. Extensions 59 and 60 are of such dimensions to allow pivot block 28 to pivot smoothly about the axis created by extension 59 through left side rail 5 and extension 60 through right side rail 6.

FIG. 7 is a side elevational view of device 1 being utilized on a flat surface 44. To utilize device 1, the adjustable pivoting screw anchor assembly 2 is mounted so that the anchoring screw 19 is screwed into a screw opening 45 on the flat surface 44. The sliding block assembly 3 may then be slid along the rails 5 and 6 and the adjustable pivoting screw anchor assembly 2 may be pivoted to the proper position so that the screwdriver tip 41 may be pressed against the screw 43. Screwdriver tip 41 is for a screw with a multiple-edge screw head such as screw 43 in flat surface 44. Screw 43 is the screw which needs to be removed. In FIG. 7, tool attachment 39 is connected to the upper portion of sliding block assembly 3 and may be utilized along with pressure applied to the tool attachment 39 by the user turning the drive element 23 in order to remove screw 43. Pressure may also be applied by the user by the use of pressure handle assembly 4. With the user pressing downward on pressure handle assembly 4, greater pressure can be made to bear on the screw 43.

FIG. 8 is a side elevational view of device 1 being utilized on a curved surface 46. The screw desired to be removed is screw 48, which is a screw with a single-edge screw head. The adjustable pivoting screw anchor assembly 2 would be placed so that the anchoring screw 19 could be screwed into the screw opening 47 which already exists in curved surface 46. The sliding block assembly 3 has placed upon it a ratchet type tool attachment 42 which may be utilized to move the drive element 23 in order to remove the screw 48. Screw tip 61, which is a screw tip for a screw with a single-edge screw head, is utilized in order to remove the screw 48, which is a screw with a single-edge screw head. It should be noted that for maximum efficiency, sliding block assembly 3 should be in such a position that the screw tip 61 enters the screw 48 at a point perpendicular to the surface in which the screw 48 is secured. The adjustable pivoting screw anchor assembly 2 may be pivoted and angled in any desired manner to insure the perpendicularity of the sliding block assembly 3 to the point of the surface where the screw 48 is located.

FIG. 9 is a sectional view taken at section 9—9 of FIG. 6. Within threaded anchor screw retaining member 18, the flap top 38 of anchoring screw 19 presses against the flat bottom portion 58 of threaded end portion 37 of shaft base 17. Threaded anchor screw retaining member 18 is screwed onto the threaded end portion 37 of shaft base 17 until the point that the flat bottom portion 58 of threaded end portion 37 presses firmly against the flat top 38 of anchoring screw 19. The pressure between the surface of flat top 38 and flat bottom portion 58 exerted is sufficient pressure to rigidly anchor device 1 when anchoring screw 19 is screwed into a threaded hole by use of screw anchor knob 15.

FIG. 10 is a sectional view taken at section 10—10 of FIG. 6. Anchoring screw 19 has a flat top 38, although a different shaped top would be usable if desired. The lower area of threaded anchor screw retaining member 18 is designed to hold screws of different sizes and has a sloped opening 57 so that the screw heads of the different size screws would all fit appropriately within the bottom section of threaded anchor screw retaining member 18.

The device 1 is an invention for removing a plurality of screws that are corroded, stuck, or have screw heads that are damaged without damaging the surface that the screws secure. The device has an adjustable pivoting screw anchor assembly which can be secured into one of the threaded screw holes in a surface to anchor the device. The device also provides a sliding block assembly which can be positioned over a plurality of screws to be removed from the initial anchored position. The adjustable pivoting screw anchor assembly is adjustable and pivots in order to utilize the device for removing a plurality of screws in a flat or curved surface. When the device is anchored into one of the threaded screw holes in a surface, the device can be positioned so that the removal screw tip is perpendicular to the screw surface of the screw being removed.

A pressure handle assembly is also provided as part of the device for removing a plurality of screws from a surface which may be utilized for better gripping, applying leverage, and multiplying the force on the screw being removed. This device can provide quick and sufficient pressure to remove the desired screw without damaging the surface, the threaded screw being removed, or the threaded screw hole. This invention can be utilized with different size and types of screw tips for removal of screws with different types of screw heads. This invention is also simple, compact, light, and safe to use. A variety of driving handle mechanisms, such as a "T" handle or ratchet, may be utilized with the invention. A pressure handle assembly is provided which contains storage means sufficiently large to utilize for storage of a variety of screws and screw tips to be utilized with the device. This device can be stored quickly and compactly and is easily removed from the storage position to a position for utilization.

The adjustable pivoting screw anchor assembly 2 is a screw anchor assembly 2. The sliding block assembly 3 is a screw removal assembly 3. The tool attachments 39 and 42 are driving means. The screw anchor assembly 2 has a height adjustment knob 16 and a threaded hollow shaft 36. Screw anchor assembly 2 has anchoring screw turning means which comprises screw anchor knob 15, shaft 35, shaft base 17, and threaded end portion 37. The screw anchor assembly 2 has a structural member which is pivot block 28. The screw removal assembly 3 has a structural body which is sliding block 21. The pressure handle assembly 4 has a stop bolt 13 which is utilized as a stop. The structure of device 1 comprises rails 5 and 6.

The screw anchor assembly 2 is designed so that the height may be adjusted. The screw anchor assembly 2 may pivot on the structure. The screw removal assembly 3 is slidably mounted on the structure.

The device 1 is easily stored. In storing device 1, the driving means 39 or 42 may be removed. The screwdriver tip holder 40 and the screwdriver tip 41 or 61 may be removed. The height adjustment means on the screw anchor assembly 2 would be adjusted so that when the tip of the anchoring screw 19 was pressed into the locking indentation 34 in the screw removal assembly 3, the pressure handle 25 may pivot to lie between rails 5 and 6. The height adjustment means may then be adjusted to press the tip of anchoring screw 19 into locking indentation 34 in order to lock the screw anchor assembly 2, the screw removal assembly 3, and the pressure handle assembly 4 rigidly together for storage.

Shoulder 63 above flat bottom portion 58 enables the threaded end portion 37 of shaft base 17 to be screwed within threaded anchor screw retaining member 18 until the flat bottom portion 58 directly contacts the top 38 of screw 19. The shoulder 63 acts as an extension piece to allow differrent size screws 19 to be utilized in device 1. The shoulder 63 enables the screw 19 to be tightened until it is tightly secured within the threaded anchoring screw retaining member 18 without the threaded portion being bottomed out within the threaded anchoring screw retaining member 18.

This device 1 may prevent hours of needless work spent to remove screws which have been corroded, stuck or damaged. Removal of the screw by use of this device 1 lessens the possibility of damage to metal around the screw or to the screw opening itself. The device 1 is simple, compact, light, and safe to utilize.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for removing a plurality of screws from a surface utilizing a threaded screw opening in said surface comprising:

a. a structure;

b. a screw anchor assembly, adjustably and pivotably mounted on said structure and operative to be secured in said threaded screw opening, comprising:

(1) an anchoring screw operative to be secured into said threaded screw opening;

(2) anchoring screw turning means rigidly securable to said anchoring screw operative to move said anchoring screw to be secured into or removed from said threaded screw opening; and (3) height adjustment means adjustably and pivotably mounted on said structure and operative to vary the height of said screw anchor assembly with respect to said structure and, therefore, the distance of said anchoring screw from said structure, said height adjustment means operating independent of the movement of said anchoring screw turning means, with said anchoring screw turning means secured within said height adjustment means;

c. a screw removal assembly adjustably mounted on said structure operative to be pressed into the top of one of said plurality of screws;

d. driving means secured to said screw removal assembly operative to move said screw removal assembly in order to remove said one of said plurality of screws from said surface; and e. wherein said screw anchor assembly further comprises an anchoring screw retaining member operable to hold said anchoring screw and securable to said anchoring screw turning means, wherein said anchoring screw retaining member has a sloped lower section whereby said anchoring screw may have a screw head of varying dimensions and still properly be secured in said anchoring screw retaining member, whereby said anchoring screw is held rigidly in said screw anchor assembly when said anchoring screw is placed into said anchoring screw retaining member, and said anchoring screw retaining member is rigidly secured to said anchoring screw turning means, whereby said screw removal assembly can be positioned over any of said plurality of screws remaining for removal purposes by utilizing said threaded screw opening or another threaded screw opening in said surface which might be created by removal of any one of said plurality of screws.

2. A device according to claim 1 further comprising a pressure handle assembly pivotably secured to said structure and operative to aid in gripping said device, applying leverage to said screw removal assembly, and multiplying the force exerted in order to remove one of said plurality of screws.

3. A device according to claim 1 wherein said anchoring screw turning means has a flat bottom which presses against the top of said anchoring screw within said anchoring screw retaining member in order to rigidly secure said anchoring screw.

4. A device according to claim 1 wherein said anchoring screw turning means has a flat bottom which presses against the top of said anchoring screw within said anchoring screw retaining member in order to rigidly secure said anchoring screw.

5. A device according to claim 1 wherein said anchoring screw turning means extends above, through, and below said height adjustment means.

6. A device according to claim 1 further comprising a structural member pivotably mounted on said structure with said structural member comprising an opening through which a portion of said height adjustment means extends.

7. A device according to claim 6 wherein said screw anchor assembly further comprises securing means secured to said structural member operative to mount said structural member pivotably on said structure.

8. A device according to claim 6 wherein said opening in said structural member is a threaded opening and said portion of said height adjustment means extending therethrough is a threaded portion.

9. A device according to claim 1 wherein said screw removal assembly comprises:

a. a structural body adjustably mounted on said structure;

b. a drive element extending through said structural body;

c. a tip holder securable to the driven end of said drive element; and d. a screwdriver tip securable within said tip holder and operative to be pressed into said top of said one of said plurality of screws.

10. A device according to claim 9 wherein said screw removal assembly further comprises:

a. a pressure bearing secured into said structural body with said drive element extending therethrough;

b. a retaining collar secured to said driven end of said drive element and operative to press against said pressure bearing and to secure said drive element within said structural body; and c. retaining means securing said retaining collar to said drive element.

11. A device according to claim 9 wherein said tip holder is operative to hold one of a plurality of screwdriver tips of varying dimensions.

12. A device according to claim 9 wherein said structure comprises a plurality of rails and said structural body comprises a plurality of body extensions extending therefrom whereby said plurality of body extensions extend over said plurality of rails thereby slidably mounting said screw removal assembly on said structure.

13. A device according to claim 1 wherein said driving means is a "T" handle secured to said screw removal assembly.

14. A device according to claim 1 wherein said driving means is a ratchet handle secured to said screw removal assembly.

15. A device according to claim 2 wherein said pressure handle assembly comprises storage means.

16. A device according to claim 2 wherein said pressure handle assembly comprises:

a. a pressure handle;

b. a pivot section pivotably secured to said structure allowing said pressure handle to be folded and stored compactly within said structure;

c. a stop secured to said structure; and d. a pressure surface located between said pressure handle and said pivot section and operative to press against said stop when pressure is applied by said pressure handle.

17. A device according to claim 16 wherein said pressure handle assembly further comprises a storage stop section operative to press against said stop to aid in securing said pressure handle assembly when said device is stored.

18. A device according to claim 1 wherein said screw removal assembly has an indentation opening within which the top of said anchoring screw is secured when said device is stored, whereby said tip of said anchoring screw is protected when said device is stored.

19. A device according to claim 18 further comprising a pressure handle assembly which is pivotably secured to said structure and is operative, when stored, to be secured within said structure pressing against said screw removal assembly with said tip of said anchoring screw tightened into said indentation thereby securing said pressure handle assembly, said screw removal assembly, and said screw anchor assembly tightly together.

20. A device according to claim 2 wherein said screw anchor assembly further comprises an anchoring screw retaining member operable to hold said anchoring screw and securable to said anchoring screw turning means, whereby said anchoring screw is held rigidly in said screw anchor assembly when said anchoring screw is placed into said anchoring screw retaining member, and said anchoring screw retaining member is rigidly secured to said anchoring screw turning means.

21. A device according to claim 20 wherein said anchoring screw turning means has a flat bottom which presses against the top of said anchoring screw within said anchoring screw retaining member in order to rigidly secure said anchoring screw.

22. A device according to claim 20 wherein said anchoring screw turning means has a flat bottom which presses against the top of said anchoring screw within said anchoring screw retaining member in order to rigidly secure said anchoring screw.

23. A device according to claim 2 wherein said anchoring screw turning means extends above, through, and below said height adjustment means.

24. A device according to claim 2 further comprising a structural member pivotably mounted on said structure with said structural member comprising an opening through which a portion of said height adjustment means extends.

25. A device according to claim 24 wherein said screw anchor assembly further comprises securing means secured to said structural member operative to mount said structural member pivotably on said structure.

26. A device according to claim 24 wherein said opening in said structural member is a threaded opening and said portion of said height adjustment means extending therethrough is a threaded portion.

27. A device according to claim 2 wherein said screw removal assembly comprises:

a. a structural body adjustably mounted on said structure;

b. a drive element extending through said structural body;

c. a tip holder securable to the driven end of said drive element; and d. a screwdriver tip securable within said tip holder and operative to be pressed into said top of said one of said plurality of screws.

28. A device according to claim 27 wherein said screw removal assembly further comprises:

a. a pressure bearing secured into said structural body with said drive element extending therethrough;

b. a retaining collar secured to said driven end of said drive element and operative to press against said pressure bearing and to secure said drive element within said structural body; and c. retaining means securing said retaining collar to said drive element.

29. A device according to claim 27 wherein said tip holder is operative to hold one of a plurality of screwdriver tips of varying dimensions.

30. A device according to claim 27 wherein said structure comprises a plurality of rails and said structural body comprises a plurality of body extensions extending therefrom whereby said plurality of body extensions extend over said plurality of rails thereby slidably mounting said screw removal assembly on said structure.

31. A device according to claim 2 wherein said driving means is a "T" handle secured to said screw removal assembly.

32. A device according to claim 2 wherein said driving means is a ratchet handle secured to said screw removal assembly.

* * * * *